US011338311B2

(12) United States Patent
Lessley

(10) Patent No.: US 11,338,311 B2
(45) Date of Patent: May 24, 2022

(54) FLUID APPLICATION DEVICE HAVING A NOZZLE WITH INDIVIDUALLY METERED ORIFICE OR ORIFICES

(71) Applicant: Illinois Tool Works Inc., Glenview, IL (US)

(72) Inventor: Mel Steven Lessley, Villa Hills, KY (US)

(73) Assignee: Illinois Tool Works Inc., Glenview, IL (US)

( * ) Notice: Subject to any disclaimer, the term of this patent is extended or adjusted under 35 U.S.C. 154(b) by 252 days.

(21) Appl. No.: 14/670,136

(22) Filed: Mar. 26, 2015

(65) Prior Publication Data

US 2015/0273505 A1 Oct. 1, 2015

Related U.S. Application Data

(60) Provisional application No. 61/973,541, filed on Apr. 1, 2014.

(51) Int. Cl.

| | |
|---|---|
| ***B05B 1/16*** | (2006.01) |
| ***B05B 12/08*** | (2006.01) |
| ***B05C 5/02*** | (2006.01) |

(52) U.S. Cl.

CPC ..... *B05B 12/085* (2013.01); *B05B 1/16* (2013.01); *B05C 5/0241* (2013.01); *B05C 5/0279* (2013.01)

(58) Field of Classification Search

CPC ... B05C 5/0279; B05C 5/0241; B05B 12/085; B05B 1/14; B05B 1/16

(Continued)

(56) References Cited

U.S. PATENT DOCUMENTS 3,192,562 A * 7/1965 Powell ..... D01D 5/30 250/396 R
4,949,668 A * 8/1990 Heindel ..... A61F 13/15642 118/314

(Continued)

FOREIGN PATENT DOCUMENTS

| | | | |
|---|---|---|---|
| JP | 2554731 | B2 | 11/1996 |
| JP | 2013215580 | A | 10/2013 |
| WO | 2011008390 | A1 | 1/2011 |

OTHER PUBLICATIONS

International Search Report for PCT/US2015/023207 dated Jun. 26, 2015.

(Continued)

*Primary Examiner* — Jason J Boeckmann
(74) *Attorney, Agent, or Firm* — Levenfeld Pearlstein, LLC

(57) ABSTRACT

A fluid application device and method of controlling the dispensing of the from the fluid delivery device are provided. The fluid application device includes a metering device configured to receive the fluid and has one or more metering pumps configured to meter the fluid flowing through each pump, a discrete fluid delivery conduit extending from each metering pump, the fluid delivery conduit configured to receive the metered fluid, and a nozzle assembly fluidically connected to the metering device. The nozzle assembly includes one or more orifices. Each metering pump is fluidically connected to at least one orifice, respectively, of the one or more orifices via a respective delivery conduit. The method includes positioning the metering device upstream from the one or more orifices and controlling a flow rate of the fluid delivered from each metering pump to at least one orifice associated with the metering pump.

19 Claims, 5 Drawing Sheets

(58) Field of Classification Search
USPC ..... 239/555
See application file for complete search history.

(56) References Cited

U.S. PATENT DOCUMENTS

| | | | | |
|---|---|---|---|---|
| 5,794,859 | A * | 8/1998 | Goenka | B05B 1/30 239/555 |
| 5,882,573 | A | 3/1999 | Kwok et al. | |
| 6,378,784 | B1 * | 4/2002 | Allen | B05B 7/0861 239/296 |
| 6,601,741 | B2 | 8/2003 | McGuffey | |
| 2002/0083895 | A1 * | 7/2002 | Nakamura | A61F 13/15593 118/325 |
| 2005/0242108 | A1 * | 11/2005 | Harris | B05B 7/2486 222/1 |
| 2013/0240122 | A1 | 9/2013 | Adams | |

OTHER PUBLICATIONS

European Search Report issued by EPO in connection with EP Application No. 15715114.3 dated Jun. 11, 2019.

* cited by examiner

FLUID APPLICATION DEVICE HAVING A NOZZLE WITH INDIVIDUALLY METERED ORIFICE OR ORIFICES

BACKGROUND

The following description relates to a fluid application device for applying a fluid on a material, for example, a fluid application device having a nozzle with individually metered orifices for dispensing the fluid.

Disposable hygiene products, or similar products, are designed to fit snuggly around a wearer of the product. To this end, these products may include a strand or strands of an elastic material around an opening on the product that is configured to fit around a portion of the wearer. For example, the elastic strand or strands may extend around opening configured to fit around a wearer's leg or abdomen. In other products, the strands of elastic material may additionally extend around openings configured to fit around a wearer's waist, arm, wrist, ankle or neck, for example.

The products include a substrate, for example, a non-woven, film or non-woven/film laminate material, to which the elastic strands are bonded to with an adhesive. Traditionally, the elastic strands may be fed past or through a nozzle of a fluid application device. The nozzle may include a plurality of orifices through which the adhesive is dispensed onto the elastic strands. The nozzle may be a contact-type nozzle where the adhesive is applied directly onto the elastic strands or a non-contact-type nozzle where the adhesive is dispensed over a gap between the elastic strands.

Traditionally, a single metering device, for example, a metering pump, is positioned at a supply tank or metering station, remote from the fluid application device, to supply the adhesive to multiple orifices of a nozzle. Thus, the adhesive supplied to the nozzle is supplied at a single pressure, as controlled by the metering pump. In turn, the adhesive is supplied to each orifice at a single pressure or flow rate.

Different application patterns or properties for the adhesive on the elastic strands may be desired depending on a particular product or application for the product. For example, it may be beneficial for elastic strands adhered to a substrate and configured to fit around an opening in the product surrounding a wearer's leg to have a different adhesive application pattern than elastic strands adhered to the substrate and configured to fit around an opening in the product surrounding the wearer's waist. In addition, it may be beneficial for adjacent strands to have different adhesive application patterns or properties, such a volume per length.

However, in the configurations described above, properties, such as the volume or flow rate, or an application pattern of the adhesive may not be independently controlled for each orifice of the nozzle because adhesive flow to each orifice is controlled by a single, common metering pump. Thus, in typical configurations, multiple fluid application devices and/or nozzles are required to apply the adhesive to strands in different patterns or with different properties. Alternatively, a substrate may have to be fed past a nozzle multiple times, varying output from the metering pump each time, to provide elastic strands having different adhesive application properties or patterns to be adhered to the substrate. These processes increase manufacturing time and may require excess equipment.

Accordingly, it is desirable to provide a fluid application device having a metering device with multiple metering pumps to control adhesive supply to individual nozzle orifices, so that output of the adhesive from each orifice may be independently controlled, thereby allowing for different simultaneous adhesive application patterns and properties to respective elastic strands.

SUMMARY

According to one aspect, there is provided a fluid application device for applying a fluid on a material. The fluid application device includes a metering device configured to receive the fluid, the metering device having one or more metering pumps configured to meter the fluid flowing through each metering pump, a discrete fluid delivery conduit extending from each metering pump of the one or more metering pumps, the fluid delivery conduit configured to receive the metered fluid, and a nozzle assembly fluidically connected to the metering device, the nozzle assembly having one or more orifices. Each metering pump is fluidically connected to at least one orifice, respectively, of the one or more orifices via a respective delivery conduit.

According to another aspect, there is provided a fluid application device for applying a fluid on a strand of material. The fluid application device includes a metering device configured to receive the fluid, the metering device having one or more metering pumps configured to meter the fluid flowing through each metering pump, a discrete fluid delivery conduit extending from each metering pump of the one or more metering pumps, the fluid delivery conduit configured to receive the metered fluid and a nozzle assembly fluidically connected to the metering device, the nozzle assembly having one or more orifices. At least one metering pump is fluidically connected to a respective orifice via a respective delivery conduit, so that the respective orifice is configured to receive the metered fluid from a respective metering pump of the at least one metering pump.

According to still another aspect, there is provided a fluid application device for applying a fluid on a strand of material. The fluid application device includes a metering device configured to receive the fluid, the metering device having one or more metering pumps configured to meter the fluid flowing through each metering pump, a discrete fluid delivery conduit extending from each metering pump of the one or more metering pumps configured to receive the metered fluid, and a nozzle assembly fluidically connected to the metering device, the nozzle assembly having a plurality of orifices. At least one metering pump of the one or more metering pumps is fluidically connected to a group of orifices of the plurality of orifices via a respective delivery conduit, such that respective groups of orifices are configured to receive the metered fluid from a respective metering pump of the at least one the metering pump.

According to yet another aspect, there is provided a method of controlling the dispensing of a fluid from a fluid application device. The fluid application device includes a metering device configured to receive the fluid, the metering device having one or more metering pumps configured to meter the fluid flowing through each metering pump, a discrete fluid delivery conduit extending from each metering pump of the one or more metering pumps, the fluid delivery conduit configured to receive the metered fluid and a nozzle assembly fluidically connected to the metering device, the nozzle assembly having one or more orifices, wherein each metering pump is fluidically connected to at least one orifice of the one or more orifices via a respective delivery conduit. The method includes positioning the metering device upstream from the one or more orifices and controlling a flow rate of the fluid delivered from each metering pump to at least one orifice associated with the metering pump.

Other objects, features, and advantages of the disclosure will be apparent from the following description, taken in conjunction with the accompanying sheets of drawings, wherein like numerals refer to like parts, elements, components, steps, and processes.

DETAILED DESCRIPTION

Figure 1:
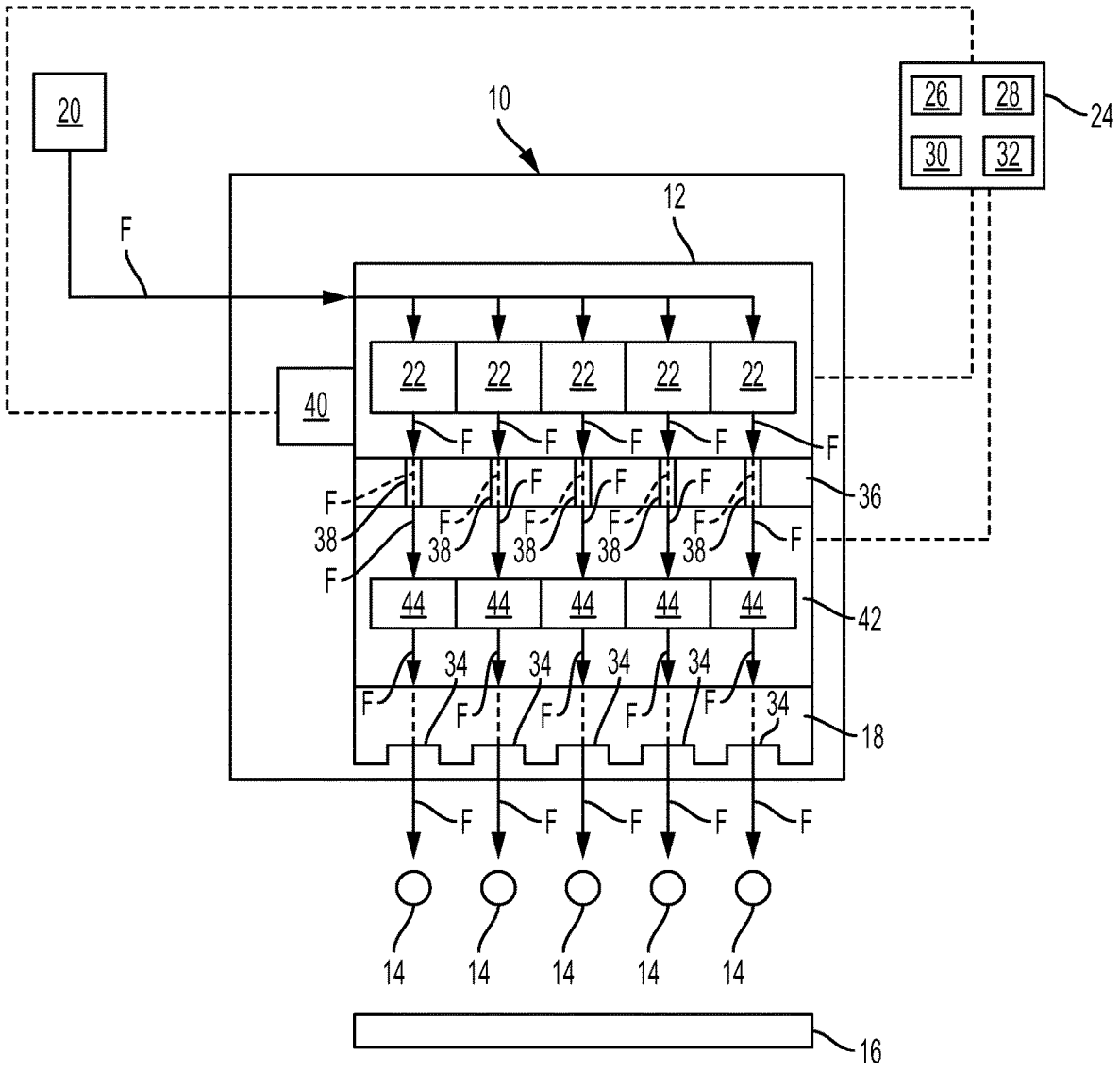
FIG. 1 is a schematic diagram of a fluid application device according to an embodiment described herein.

While the present disclosure is susceptible of embodiment in various forms, there is shown in the drawings and will hereinafter be described one or more embodiments with the understanding that the present disclosure is to be considered illustrative only and is not intended to limit the disclosure to any specific embodiment described or illustrated.

FIG. 1 is a schematic diagram of a fluid application device 10 having a metering device 12 according to an embodiment described herein. The fluid application device 10 may be used to apply a fluid F on a material, such as a strand of material 14 or a substrate 16. The fluid F may be, for example, a viscous fluid that is a liquefied material heated or non-heated between about 10 and 50,000 centipoise (cps). The fluid F may further be, for example, an adhesive, such as a hot melt adhesive.

The strand of material 14 may be made from an elastic material and may be in either a stretched or relaxed condition as the fluid F is applied. The strand 14 of material may be, for example, spandex, rubber or other similar elastic material. The strand 14 of material, with the fluid F applied thereto may be positioned on and bonded to a substrate 16, such as a non-woven material. Alternatively, the fluid F may be applied directly on the substrate 16.

According to one embodiment, the fluid application device 10 includes the metering device 12 and one or more nozzle assemblies 18. The metering device 12 is configured to receive the fluid F from a fluid supply source 20, which may be positioned upstream and remote from the fluid application device 10. The metering device 12 may be secured and/or fluidically connected to, or formed integrally with, an adjacent component of the fluid application device 10, such as an applicator head (not shown).

The metering device 12 includes one or more metering pumps 22. The metering pumps 22 may be precision metering pumps. Each metering pump 22 is configured to control flow of, i.e., meter, the fluid F therethrough. For example, each metering pump 22 may control a flow rate of the fluid F flowing therethrough. To this end, each metering pump 22 may be configured to allow for a maximum flow rate, and this maximum flow rate may vary amongst the different metering pumps 22. For example, one metering pump 22 may be configured to provide a maximum flow rate of 1.0 cubic centimeter (cc) per unit of time. Another metering pump 22 may be configured to provide a maximum flow rate of 0.5 cc per unit of time, while yet another metering pump may be configured to provide a maximum flow rate of 0.3 cc per unit of time. It is understood that the flow rates above are described for the purposes of example only, and the present disclosure is not limited to the flow rates or the specific ratios of the flow rates described above. The metering pumps 22 are modular, and can be removed and/or replaced to provide a desired flow rate. For example, a metering pump 22 operable to provide a predetermined flow rate of 0.7 cc may be replaced with a metering pump 22 configured to operate at 0.9 cc when a higher flow rate is desired.

The metering pumps 22 of the metering device 12 are controlled or powered by a motor, such as a servo or AC motor 40. That is, metering pumps 22 are configured to be driven by an output from the servo or AC motor 40. For example, the servo or AC motor 40 may be connected to each metering pump 22 by a single drive shaft (not shown). Rotation of the drive shaft causes the metering pumps 22 to operate. As a result, the metering pumps 22 operate at a constant output (flow rate) ratio relative to one another. The output, or flow rate of the fluid F from the metering pumps 22 may be varied by varying the output of the servo or AC motor 40. For example, a first metering pump may operate at 1.0 cc, while a second metering pump may operate at 0.8 cc. The servo or AC motor 40 may be controlled or operated such that the output of the motor 40 is reduced by 25%. Accordingly, the flow rate output from the first metering pump would be reduced to 0.75 cc, and the flow rate output from the second metering pump would be reduced to 0.6 cc. That is, the first pump, in this example, operates at a constant ratio of 1.25 relative to the second pump. It is understood that the present disclosure is not limited to this example, and pumps having operating ratios different than that of the example above are envisioned as well.

In one embodiment, the servo or AC motor 40, and in turn, the metering pumps 22 may be operatively and communicatively connected to a controller 24. The controller 24 is configured to selectively control the servo or AC motor 40 so that the metering pumps 22 provide the fluid F at a desired flow rate. In one example, the controller 24 may control the servo or AC motor 40 so that the flow rate output from the metering pumps 22 varies with time.

The controller 24 may include, for example, an input/output (I/O) unit 26 configured to send and/or receive data to/from an external device, a memory unit 28 configured to store data, a receiving unit 30 and a sending unit 32. It is understood that the various features of the controller 24 described above are operably and communicatively connected to one another. It is further understood that these devices, while described as being part of the controller 24, may be separate from controller 24 and operably and communicatively connected thereto. The controller 24 may be integrated with metering device 12, or alternatively, may be separate from the metering device 12 and operably and communicatively connected thereto. For example, the controller 24 may be positioned on, secured to, communicatively connected to, or integrated with another component of the fluid application device 10.

The controller 24 may be implemented as a microprocessor or computer having a microprocessor configured to execute program instructions stored in one or more computer-readable storage media, such as, but not limited to, the memory unit 28. Computer-readable storage media include non-transitory media, for example, magnetic media, including hard disks and floppy disks; optical media including CD ROM disks and DVDs, and/or optical disks. Computer-readable storage media may also include hardware devices configured to store and/or perform program instructions, including read-only memory (ROM), random access memory (RAM), flash memory and the like. It is understood that non-transitory media does not include signals or waves.

Figure 2:
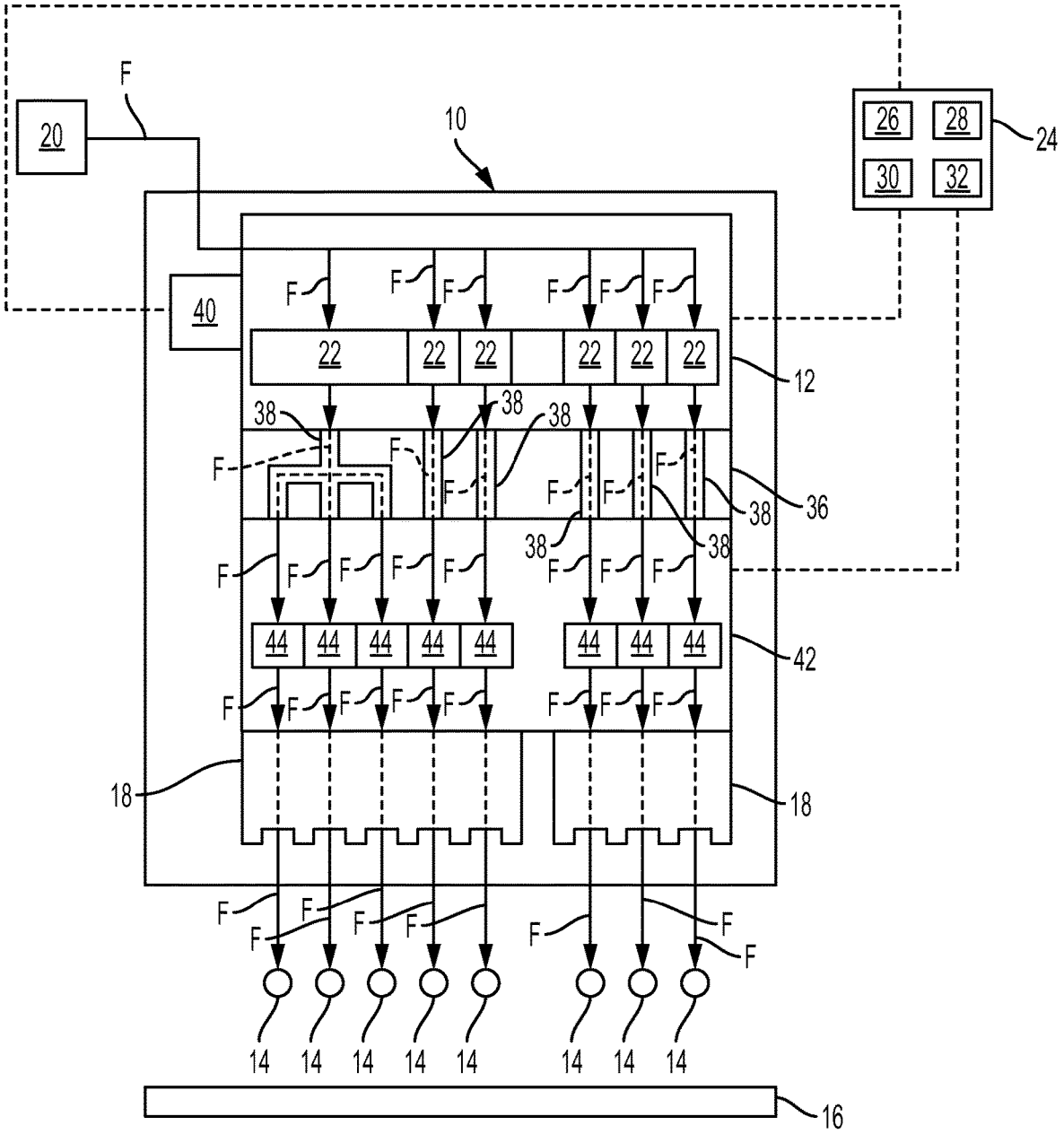
FIG. 2 is a schematic diagram showing another example of a fluid application device according to an embodiment described herein.

The nozzle assembly 18 is fluidically connected to the metering device 12 such that the nozzle assembly 18 may receive the fluid F from the metering device 12. The nozzle assembly 18 includes one or more orifices 34 through which the fluid F may be discharged for application onto the material. In one embodiment, the fluid F is dispensed from the one or more orifices 34 onto respective strands of material 14. That is, in one embodiment, each orifice 34 is configured to discharge or dispense the fluid F onto a single strand 14 of material. Each orifice 34 is configured to receive the fluid F from a respective metering pump 22. Alternatively, as shown in FIG. 2, more than one orifice 34, i.e., a group of orifices, may receive the fluid F from a single metering pump 22. Said differently, each metering pump 22 may supply the fluid F to one or more orifices 34 of the nozzle assembly 18. In this example, fluid flow from a single metering pump 22 may be divided to flow to multiple orifices 34 either in the metering device 12 or in the nozzle assembly 18. As a further example, one orifice 34 may receive the fluid F from a first metering pump 22, while a group of orifices, separate from the one orifice, may receive the fluid F from a second metering pump 22. The nozzle assembly 18 may further include a plurality of fluid inputs configured to receive the fluid F from the respective metering pumps 22. In one embodiment, the number of fluid inputs corresponds to the number of orifices.

In one embodiment, the fluid application device 10 includes a manifold 36. The manifold 36 may be part of, i.e., formed integrally with as a single unit, the metering device 12 or the nozzle assembly 18. The manifold 36 includes one or more discrete delivery conduits 38. The delivery conduits 38 may be disposed in and/or extend through, for example, the metering device 12, the nozzle assembly 18, or both. Each delivery conduit 32 may extend between a respective metering pump 22 and the fluid inputs of the nozzle assembly 18 for delivering the fluid F from the metering pump 22 to the orifice 34. In on embodiment, the manifold 36 is modular and may be replaced or paired with a corresponding nozzle assembly 18 such that the number of delivery conduits 38 corresponds to the number of orifices 34.

The fluid application device 10 may further include an adapter or valve module 42 positioned between the metering device 12 and the nozzle assembly 18. The adapter 42 includes a plurality of valves 44. Each valve is positioned in a flow path, i.e., a delivery conduit 32, extending between a metering pump 22 and one or more orifices 34 associated with that metering pump 22 (i.e., one or more orifices configured to receive the fluid from a specific metering pump). Accordingly, each valve 42 is operable to start or stop a flow of the fluid F from a metering pump 22 to the associated one or more orifices 34. That is, the valves 42 may be individually actuated between an ON condition where fluid flow is permitted therethrough and an OFF position where fluid flow therethrough is stopped. The valves 44 may be operably and communicatively connected to the controller 24 such that the controller 24 may selectively and independently operate each valve 44. The delivery conduits 38 may extend through the adapter 42 and valves 44 as well. The manifold 36 may alternatively be formed integrally with the adapter 42. Thus, the manifold 36 may formed separately from and installed adjacent to any of the metering device 12, the adapter 42 and the nozzle assembly 18. Alternatively, the manifold 36 may be formed integrally with any of the metering device 12, adapter 42 and the nozzle assembly 18.

The nozzle assembly 18 may be formed as either a contact nozzle assembly or a non-contact nozzle assembly. In a contact nozzle assembly 18, the fluid F is applied directly from each orifice onto a respective strand. That is, in a contact nozzle assembly, the strand 14 is positioned immediately adjacent to, or partially within, the orifice 34, such that the fluid bonds to the strand 14 in a substantially linear pattern as the strand 14 is fed by the orifice 34. In a non-contact nozzle assembly, the fluid F is discharged from each orifice 34 over gap and onto a respective strand 14. That is, in the non-contact nozzle assembly, the strand 14 is spaced from the orifice 34. In addition, the non-contact nozzle assembly may include additional outlets (not shown). For example, at least one outlet may be associated with each orifice 34. The at least one outlet may discharge a second fluid, such as air, that causes the fluid F discharged from the orifice 34 to oscillate or vacillate as the fluid F is applied on the strand 14. Thus, the fluid F may be applied to the strand 14 in a substantially non-linear pattern using a non-contact nozzle assembly.

In another embodiment, the nozzle assembly 18 may be formed as a die extruder and shim. This configuration may be used to contactingly apply the fluid F to the material. It is understood, that in the examples above, each type of nozzle assembly, i.e., the contact nozzle assembly, the non-contact nozzle assembly, and the die extruder and shim, includes the one or more orifices 34 described above. Thus, the metering device 12 described above may be used in conjunction with, for example, any of the nozzle assemblies 18 having one or more orifices 34 described above.

Figure 7:
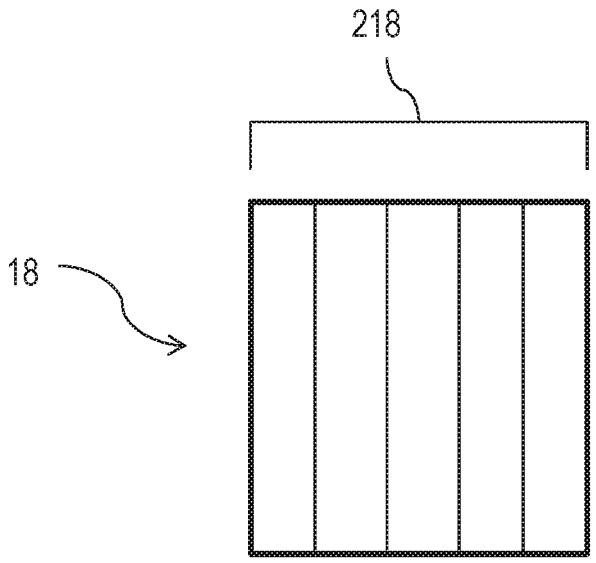
FIG. 7 is a diagram showing an example of a nozzle having formed by a plurality of stacked plates, according to an embodiment.

Referring to FIG. 7, in one example, the nozzle assembly 18 may be formed by a plurality of stacked plates 218, i.e., a laminated plate nozzle, or as noted above, a die extruder with shims. Each nozzle assembly 18, including the differently formed assemblies above, may be formed as a modular unit. That is, the nozzle assembly 18 may be selectively removed from and secured to the fluid application device 10. For example, the nozzle assembly 18 may be selectively removed from and secured to the metering device 12, or other component of the fluid application device 10. Accordingly, the nozzle assembly 18 may be replaced in the event a new or different nozzle assembly is desired or required. The nozzle assembly 18 is selectively removable from and securable to the fluid application device 10 by way of at least one securing element (not shown).

In some embodiments, the fluid application device 10 may include more than one nozzle assembly 18 to apply fluid onto the material. Each nozzle assembly 18 may be fluidically connected to the metering device 12 to receive the fluid F therefrom. Where more than one nozzle assembly 18 is implemented, the more than one nozzle assemblies 18 may include, for example, contact nozzle assemblies, non-contact assemblies, die extruder and shim plate assemblies, or a combination thereof. In one non-limiting example, the fluid application device may include up to twenty nozzle assemblies 18.

In the examples above, the metering pumps 22 of the metering device 12 may be arranged in a "tight-center" configuration. In the tight-center configuration, respective centers of immediately adjacent metering pumps 22 are positioned approximately 3-5 millimeters (mm) apart. That is, the metering pumps 22 are dimensioned and sized so that when positioned adjacent to one another, the respective centers of the immediately adjacent metering pumps 22 are approximately 3-5 mm apart. The distance between respective centers of respective metering pumps 12 may generally correspond to spacing between respective centers of adjacent orifices 34 of the nozzle assembly 18, which are also separated by a distance of approximately 3-5 mm. Similarly, other components, such as the valves 44, fluid delivery conduits 38, and fluid inputs of the nozzle assembly 18 may be spaced apart by approximately 3-5 mm. Alternatively, the metering pumps 22 of the metering device 12 may be arranged in a conventional configuration, where respective centers of adjacent pumps 22 are positioned approximately 25 mm apart.

Accordingly, in the embodiments above, a metering pump 22 may control the flow rate of the fluid F supplied to, and in turn, dispensed from the one or more orifices 34. That is, dispensing of the fluid F from an orifice 34 may be individually controlled by a metering pump 22 associated with that orifice 34. As a result, different application patterns of the fluid F onto the material may be provided from each orifice 34.

In one general non-limiting example, according to the principles described above, the metering device 12 may include three metering pumps 22 and the nozzle assembly 18 may include three orifices 34. Each metering pump 22 may supply the fluid F to a single respective orifice 34. The controller 24 may control and operate the servo or AC motor 40 to drive the three metering pumps. Each metering pump 22 may be operated to adjust a flow rate output from the metering pump 22. In addition, each metering pump 22 is modular and may be replaced with another metering pump that operates up to a maximum predetermined flow rate as described above. The valves 44 may be operated to stop and/or start a flow of the fluid F supplied to a respective orifice 34. The metering pumps 22 may be operated in a stepwise or incremental manner. Thus, in this example, the fluid F supplied to one of the three orifices 34 may be supplied at a different flow rate than the fluid F supplied to one of or both of the other orifices 34. Each metering pump 22 operates at a fixed ratio relative to the other metering pumps 22.

In another example, the nozzle assembly 18 may be a non-contact nozzle assembly, with or without air assist from adjacent outlets as described above. In one configuration, the metering pumps 22 of the metering device 12 may be arranged in a conventional configuration, where respective centers of immediately adjacent metering pumps are positioned approximately 25 mm apart. As detailed above, the metering pumps 22 of the metering device 12 are positioned at the applicator head (not shown) of the fluid application device 10, rather than at a fluid supply source remote from the fluid application device 10. As a non-limiting example, the metering device 12 may include four metering pumps 22. Each metering pump 22 may supply the fluid F to a corresponding orifice 34 of the non-contact nozzle assembly 18. Alternatively, the metering pumps 22 may supply the fluid F to corresponding orifices 34 positioned at more than one non-contact nozzle assembly. Further, at least one of the metering pumps 22 may supply fluid to more than one orifice 34, i.e., a group of orifices, of the non-contact nozzle assembly or assemblies. As another alternative, the metering pumps 22 may be arranged in the tight-center configuration, such that respective centers of immediately adjacent metering pumps are approximately 3-5 mm apart.

In still another example, the nozzle assembly 18 may be a contact nozzle assembly. In one configuration, the metering pumps 22 of the metering device 12 may be arranged in tight-center configuration, where respective centers of immediately adjacent metering pumps 22 are positioned approximately 3-5 mm apart. As detailed above, the metering pumps 22 of the metering device 12 are positioned at the applicator head (not shown) of the fluid application device 10, rather than at a fluid supply source remote from the fluid application device 10. As a non-limiting example, the metering device 12 may include four metering pumps 22. Each metering pump 22 may supply the fluid F to a corresponding orifice 34 of the contact nozzle assembly 18. Alternatively, the metering pumps 22 may supply the fluid F corresponding orifices 34 positioned at more than one contact nozzle assembly. Further, at least one of the metering pumps 22 may supply fluid to more than one orifice 34, i.e., a group of orifices, of the contact nozzle assembly or assemblies. As another alternative, the metering pumps 22 may be arranged in the conventional configuration, such that respective centers of immediately adjacent metering pumps 22 are approximately 25 mm apart.

It is understood that the present disclosure is not limited to the examples above, however. For example, a single metering pump 22 may supply the fluid F to more than one orifice (see FIG. 2). In some configurations, individual metering pumps 22 may supply the fluid F to more than orifice 34 while another metering pump or pumps 22 may supply the fluid F to respective single orifices 34. In addition, the fluid application device 10 may include more than one nozzle assembly 18 and the metering device 12, via the metering pumps 22, may simultaneously supply the fluid F to the more than one nozzle assembly 18. In this example, the nozzle assemblies 18 may vary, such that one nozzle assembly 18 is, for example, a contact nozzle assembly, and another nozzle assembly 18 is, for example, a non-contact nozzle assembly. Accordingly, greater flexibility may be afforded in applying the fluid in desired patterns.

The strands 14 of material may be applied to the substrate 16 of the product for a variety of different uses. For example, the strands 14 may be used to form leg elastics, a leg cuff, a waist band, or belly bands. The product may be, for example, baby or adult diapers, adult incontinence products, feminine hygiene products or other similar disposable hygiene products. Other products, outside of the hygiene product industry, where elasticated strands may be used are envisioned as well.

It is further understood that the number of orifices 34 and metering pumps 22 may vary depending on a specific application. For example, to form leg elastics, it may be desirable to bond anywhere from one to five elasticated strands 14 of material to the substrate 16. Accordingly, the nozzle assembly 18 may be manufactured to include anywhere from one to five orifices 34 (depending on the number of strands) and the metering device 12 may similarly include anywhere from one to five metering pumps 22. In other examples, to form a leg elastic or cuff, it may be desirable to bond anywhere from one to ten strands 14 of material to the substrate per 25 mm width. A waist band may use one to ten strands 14 of material. A belly band may use one to fifty strands 14 of material. Accordingly, the nozzle assembly 18, or multiple nozzle assemblies 18, may include a total number of orifices 34 corresponding to the number of strands 14 to which the fluid is to be applied, and the metering device 12 may similarly include a corresponding number of metering pumps 22. Thus, application of the fluid F onto each strand 14 of material may be individually controlled by controlling each metering pump 22 independently of the other metering pumps 22.

Figure 3:
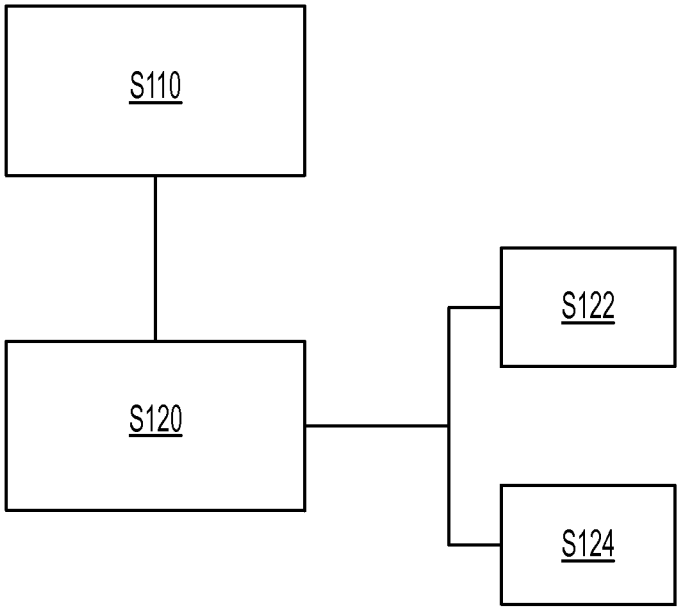
FIG. 3 is a diagram showing a method of operating a fluid application device according to an embodiment described herein.

FIG. 3 is a diagram illustrating a method of controlling the dispensing of the fluid F from a fluid application device according to one embodiment. For example, in the fluid application device 10 as described above, the method includes positioning the metering device 12 upstream from the one or more orifices 34, as shown at S110, and controlling a flow rate of the fluid F delivered from each metering pump 22 to a respective one or more orifices 34, as shown at S120. Controlling each metering pump may include, for example, increasing a flow rate of the fluid F through the metering pump at S122 or decreasing a flow rate of the fluid F through the metering pump at S124.

Figure 6:
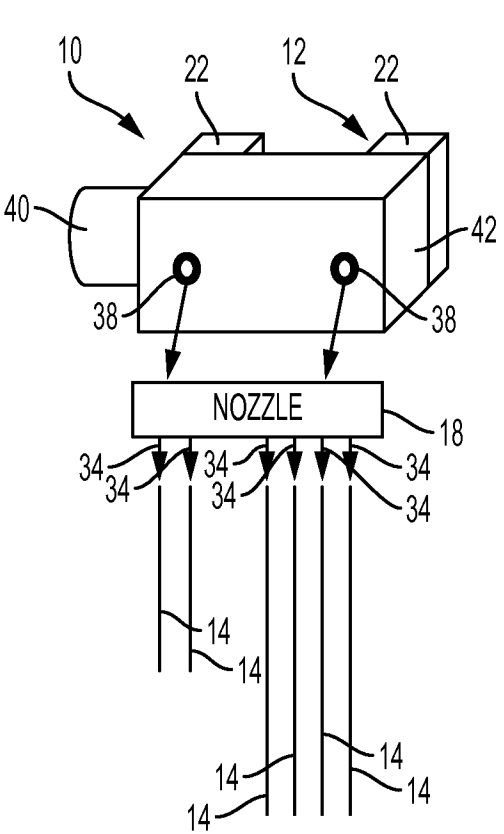
FIG. 6 is a diagram showing still another example of a fluid application device according to an embodiment described herein.
Figure 5:
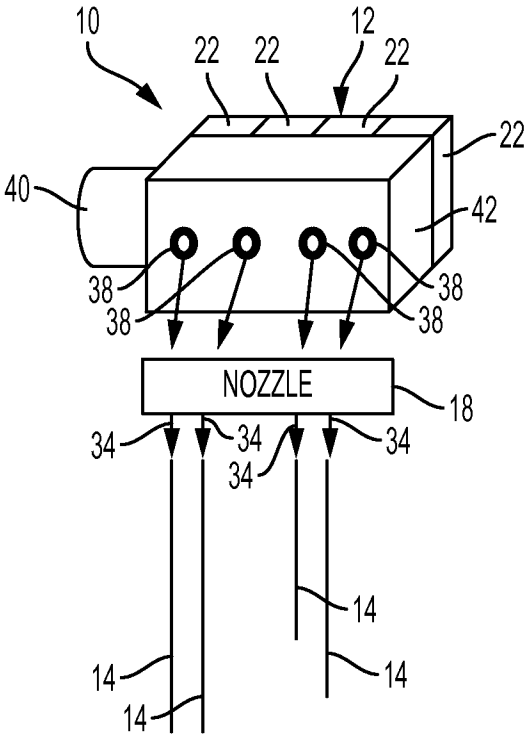
FIG. 5 is a diagram showing another example of a fluid application device according to an embodiment described herein.
Figure 4:
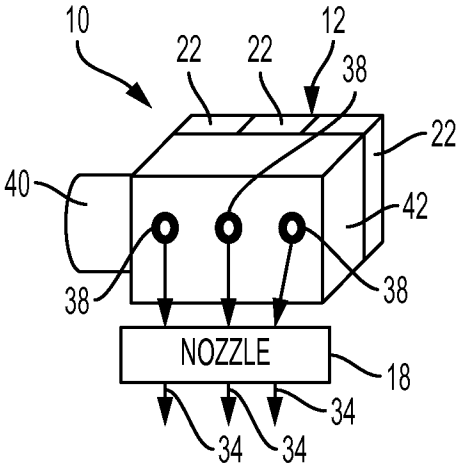
FIG. 4 is a diagram showing an example of a fluid application device according to an embodiment described herein.

FIGS. 4-6 are diagrams showing additional examples of the fluid application device 10 in accordance with the disclosure above. In one example, as shown in FIG. 4, three metering pumps 22 supply the fluid (indicated by the arrows) through respective delivery conduits 38 to the nozzle assembly 18. In this example, the nozzle assembly 18 includes three orifices 34, wherein each orifice 34 discharges fluid received from a respective metering pump 22. In the example shown in FIG. 5, four metering pumps 22 supply the fluid (indicated by the arrows) to the nozzle assembly 18 through respective delivery conduits 38. In this example, the nozzle assembly 18 includes four orifices 34, wherein each orifice discharges fluid received from a respective metering pump 22. In the example shown in FIG. 6, two metering pumps 22 supply the fluid (indicated by the arrows) to the nozzle assembly 18 through respective delivery conduits 38. In this example, the nozzle assembly 18 includes six orifices 34. Here, one metering pump 22 (shown on the left side of FIG. 6) may supply the fluid to two of the orifices 34 for discharge and application onto two respective strands of material 14. The other metering pump 22 (shown on the right side of FIG. 6) may supply the fluid to the other four orifices 34 for discharge and application onto four respective strands of material 14. It is understood that these configurations illustrate examples in accordance with the principles described herein, and the present disclosure is not limited to these examples. Further, it is understood that combinations of the examples above are also envisioned.

In the embodiments above, fluid delivery to each orifice for subsequent discharge onto a strand of material may be individually metered. Accordingly, fluid application characteristics, such as an application pattern, may be controlled at each orifice 34 of the nozzle assembly 18 by a metering pump 22 associated with that orifice (or orifices). For example, application of the fluid F on the material may be selectively increased or decreased by volume along the length of material passing by the orifice. In one example, multiple strands 14 of material may be simultaneously fed past respective orifices 34. The fluid application characteristics from strand to strand may be varied at each orifice 34. For example, the fluid F may be continuously discharged from one orifice 34 at a first flow rate corresponding to a predetermined flow rate of the metering pump 22, to coat the strand with a first volume of fluid along its length. Meanwhile, another orifice 34 may discharge the fluid F at a different, second flow rate, corresponding to a predetermined flow rate of another metering pump 22, to coat another strand of material with a second volume of fluid along its length. The first and second flow rates may be increased or decreased by operation of the servo or AC motor 40 so that the first and second flow rates vary with time. It is understood that the embodiments above, or features from the embodiments above, may be used together in different combinations not expressly described herein.

In the examples above, the metering device 12, including the one or more metering pumps 22, is positioned near the nozzle assembly 18. Accordingly, fluid delivery from the metering device 12 to the one or more orifices 34 may be precisely controlled to achieve a desired application pattern or other application characteristic on the material. This advantage may be realized across different nozzle types, i.e., contact, non-contact or die extruder and shim. In addition, the examples above may allow for increased flexibility in coating the material due, at least in part, to individually metered orifices. In turn, efficiency in the fluid application process may be improved as different fluid application characteristics may be simultaneously provided.

It should also be understood that various changes and modifications to the presently disclosed embodiments will be apparent to those skilled in the art. Such changes and modifications can be made without departing from the spirit and scope of the present disclosure and without diminishing its intended advantages. It is therefore intended that such changes and modifications be covered by the appended claims.

The invention claimed is:

1. A fluid application device for applying a fluid on a material, the fluid application device comprising:

a metering device configured to receive the fluid, the metering device having a plurality of metering pumps configured to meter the fluid flowing through each metering pump;

a manifold fluidically connected to and disposed downstream from the plurality of metering pumps;

a valve module fluidically connected to and disposed downstream from the manifold, the valve module comprising a plurality of valves;

a discrete fluid delivery conduit extending from each metering pump of the plurality of metering pumps through the manifold and the valve module, each fluid delivery conduit configured to receive the metered fluid; and a plurality of nozzles fluidically connected to the metering device via the manifold and the valve module, wherein each nozzle of the plurality of nozzles is removably secured to the valve module, each nozzle has a plurality of orifices for discharging the metered fluid;

wherein each metering pump is fluidically connected to at least one orifice of the plurality of orifices of each nozzle via a respective fluid delivery conduit, and wherein the plurality of orifices of each nozzle discharge the fluid directly to the atmosphere.

2. The fluid application device of claim 1, wherein each metering pump is fluidically connected to a respective orifice of the nozzles, so that the respective orifice is configured to receive the metered fluid from a respective metering pump of the plurality of metering pumps.

3. The fluid application device of claim 1, wherein each metering pump of the plurality of metering pumps is fluidically connected to a group of orifices of the plurality of orifices of the nozzles, such that respective groups of orifices are configured to receive the metered fluid from a respective metering pump of the plurality of metering pumps.

4. The fluid application device of claim 1, wherein a first metering pump of the plurality of metering pumps is fluidically connected to a respective orifice of the plurality of orifices, and a second metering pump of the plurality of metering pumps is fluidically connected to a group of orifices of the plurality of orifices.

5. The fluid application device of claim 1, wherein the plurality of nozzles includes a contact nozzle.

6. The fluid application device of claim 1, wherein the plurality of nozzles includes a non-contact nozzle.

7. The fluid application device of claim 1, wherein the fluid is an adhesive.

8. The fluid application device of claim 1, wherein each metering pump operates to provide the fluid at a predetermined flow rate.

9. The fluid application device of claim 8, wherein at least one metering pump provides the fluid at a predetermined flow rate different from the predetermined flow rate of another metering pump.

10. The fluid application device of claim 1, wherein each metering pump is modular so as to be selectively removable from and replaceable in the metering device.

11. The fluid application device of claim 1, wherein respective centers of immediately adjacent metering pumps are spaced apart approximately 3-5 millimeters in the metering device.

12. The fluid application device of claim 1, the valve module comprising at least one valve positioned between each metering pump and a respective orifice, each valve configured to stop or start a flow of the fluid from each metering pump to the nozzle.

13. The fluid application device of claim 1, further comprising a motor for driving the plurality of metering pumps.

14. The fluid application device of claim 1, wherein the nozzle is a laminated plate nozzle comprising a plurality of stacked plates.

15. A fluid application device for applying a fluid on a strand of material, the fluid application device comprising:

a metering device configured to receive the fluid, the metering device having a plurality of metering pumps configured to meter the fluid flowing through each metering pump;

a manifold fluidically connected to and disposed downstream from the plurality of metering pumps;

a valve module fluidically connected to and disposed downstream from the manifold, the valve module comprising a plurality of valves;

a discrete fluid delivery conduit extending from each metering pump of the plurality of metering pumps, each fluid delivery conduit configured to receive the metered fluid; and a nozzle fluidically connected to the metering device via the manifold and the valve module, wherein the nozzle is removably secured to the valve module, the nozzle having a plurality of orifices;

wherein each metering pump of the plurality of metering pumps is fluidically connected to a respective orifice of the plurality of orifices via a respective delivery conduit, so that the respective orifice is configured to receive the metered fluid from a respective metering pump of the plurality of metering pumps, and wherein the plurality of orifices of the nozzle discharge the fluid directly to the atmosphere.

16. The fluid application device of claim 15, wherein each orifice of the plurality of orifices discharges the fluid onto a respective strand of material.

17. A fluid application device for applying a fluid on a strand of material, the fluid application device comprising:

a metering device configured to receive the fluid, the metering device having a plurality metering pumps configured to meter the fluid flowing through each metering pump;

a manifold fluidically connected to and disposed downstream from the plurality of metering pumps;

a valve module fluidically connected to and disposed downstream from the manifold, the valve module comprising a plurality of valves;

a discrete fluid delivery conduit extending from each metering pump of the plurality of metering pumps through the manifold and the valve module and configured to receive the metered fluid; and a nozzle fluidically connected to the metering device via the manifold and the valve module, wherein the nozzle is removably secured to the valve module, the nozzle having a plurality of orifices;

wherein at least one metering pump of the plurality of metering pumps is fluidically connected to a group of orifices of the plurality of orifices via a respective delivery conduit, such that the group of orifices is configured to receive the metered fluid from a single metering pump of the at least one the metering pump, and wherein the plurality of orifices of the nozzle discharge the fluid directly to the atmosphere.

18. A method of controlling the dispensing of a fluid from a fluid application device, the fluid application device comprising a metering device configured to receive the fluid, the metering device having a plurality of metering pumps configured to meter the fluid flowing through each metering pump, a manifold fluidically connected to and disposed downstream from the plurality of metering pumps, a valve module fluidically connected to and disposed downstream from the manifold, the valve module comprising a plurality of valves, a discrete fluid delivery conduit extending from each metering pump of the plurality of metering pumps through the manifold and the valve module, the fluid delivery conduit configured to receive the metered fluid and a nozzle fluidically connected to the metering device via the manifold and the valve module, the nozzle being removably secured to the valve module and having a plurality of orifices, wherein each metering pump is fluidically connected to at least one orifice of the plurality of orifices via a respective delivery conduit, and wherein the plurality of orifices of the nozzle discharge the fluid directly to the atmosphere, the method comprising:

positioning the metering device upstream from the plurality of orifices of the nozzle;

controlling a flow rate of the fluid delivered from each metering pump to at least one orifice associated with the metering pump.

19. The method of claim 18, wherein controlling each metering pump includes increasing or decreasing a flow rate of the fluid through the metering pump to be delivered to the respective orifice.

* * * * *